US006478892B2

(12) United States Patent
Murakami et al.

(10) Patent No.: US 6,478,892 B2
(45) Date of Patent: Nov. 12, 2002

(54) LOW IRON LOSS NON-ORIENTED ELECTRICAL STEEL SHEET EXCELLENT IN WORKABILITY AND METHOD FOR PRODUCING THE SAME

(75) Inventors: Ken-ichi Murakami, Kitakyushu (JP); Takashi Morohoshi, Kitakyushu (JP); Tomoji Kumano, Kitakyushu (JP); Ryutaro Kawamata, Futtsu (JP); Takeshi Kubota, Futtsu (JP); Masafumi Zeze, Kitakyushu (JP); Hidekuni Murakami, Kitakyushu (JP); Shinichi Kanao, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/827,968

(22) Filed: Apr. 6, 2001

(65) Prior Publication Data

US 2001/0037841 A1 Nov. 8, 2001

(30) Foreign Application Priority Data

Apr. 7, 2000 (JP) ..... 2000-106833
Jan. 30, 2001 (JP) ..... 2001-022274

(51) Int. Cl.[7] ..... H01F 1/04

(52) U.S. Cl. ..... 148/306; 148/307; 148/111; 148/112; 148/120; 148/121

(58) Field of Search ..... 148/306, 307, 148/308, 110–112, 120, 121; 420/77, 78, 103, 117

(56) References Cited

U.S. PATENT DOCUMENTS 4,595,426 A * 6/1986 Iwayama et al. ..... 148/111

* cited by examiner

*Primary Examiner*—John P Sheehan
(74) *Attorney, Agent, or Firm*—Kenyon & Kenyon

(57) ABSTRACT

The present invention provides a non-oriented electrical steel sheet having crystal grains of small diameter and excellent workability before stress relief annealing and having crystal grains of largely grown diameter and excellent iron loss property after stress relief annealing and a method for producing the same, and relates to a low iron loss non-oriented electrical steel sheet excellent in workability, containing, in weight %, 0.010% or less of C, 0.1 to 1.5% of Mn, 0.1 to 4% of Si, 0.1 to 4% of Al, wherein the latter three elements satisfy the formula Si+Mn+Al≦5.0%, and 0.0005 to 0.0200% of Mg, or further containing 0.005% or more of Ca, wherein the total amount of Mg and Ca is 0.0200% or less, or further containing 0.005% or more of REM, wherein the total amount of Mg and REM is 0.0200% or less, or further containing 0.005% or more of Ca and REM, wherein the total amount of Mg, Ca and REM is 0.0200% or less, and containing the remainder consisting of Fe and unavoidable impurities.

12 Claims, No Drawings

LOW IRON LOSS NON-ORIENTED ELECTRICAL STEEL SHEET EXCELLENT IN WORKABILITY AND METHOD FOR PRODUCING THE SAME

BACKGROUND OF THE INVENTION

1. Field of the Invention

The present invention relates to a non-oriented electrical steel sheet excellent in workability and iron loss property which can be used as iron core material for electric apparatuses and a method for producing the same.

2. Description of the Related Art

An improvement in the efficiency of electric apparatuses has been desired intensely under the trend toward worldwide electricity and energy saving and global environmental conservation. In particular, most recently, a material with better magnetic property, i.e. better iron loss property, than that presently available has been required for a non-oriented electrical steel sheet used for rotors or stators while the efficiency upgrading of rotating machines is developing.

As a means to reduce the iron loss of a non-oriented electrical steel sheet, a method to reduce eddy current loss by increasing the content of alloying elements such as Si, Al and Mn, etc. and increasing electric resistance is widely and generally used. Further, after determining a component, it is important to attempt to optimize iron loss by adjusting the crystal grain diameter of a product sheet to about 100 to 150 $\mu$m.

With regard to workability, it has been proven recently that the problems of rough ridges and burrs, etc. occur during the punching of a motor core if the crystal grain diameter of a product sheet is too large. On the other hand, the iron loss of a core deteriorates if the crystal grain diameter of a product sheet is too small. To cope with those problems, means for reducing a crystal grain diameter during the punching of a core and of growing crystal grains to some extent during the stress relief annealing of the core have been required.

It is well-known that the most harmful precipitate as an impurity for preventing crystal grain growth markedly is MnS having a relatively low solution temperature. Though the reduction of S amount itself may reduce the precipitate in a process for refining steel, there is a limitation in industrial application. To cope with this, disclosed are methods to suppress the precipitation of fine MnS by a means to fix S in steel as precipitates with a high solution temperature using rare earth elements (REM) such as Ce and La, etc. (Japanese Unexamined Patent Publication No. S51-62115) and by a means to fix S using Ca (Japanese Unexamined Patent Publication No. S59-74213).

However, the precipitates of REM and S, for example, actually have complicated forms including oxygen and therefore, dissolve partially since they are compound precipitates even though the solution temperature is high as single substance, and precipitate again as fine precipitates with Mn. In these cases, if the precipitates of REM and Ca become the precipitation nuclei of MnS, above problem will be avoided. However, CaS which is a precipitate of Ca and S, for example, has poor lattice coherence with MnS and its performance as precipitation nucleus is poor when S is contained to some extent or more and the formation of MnS cannot be avoided.

SUMMARY OF THE INVENTION

The present invention provides a low iron loss non-oriented electrical steel sheet having a small crystal grain diameter and excellent workability during the punching of a motor core and also having a sufficiently grown large crystal grain diameter and excellent workability after stress relief annealing by a user, and a method for producing the same.

The gist of the present invention is as follows:

(1) a low iron loss non-oriented electrical steel sheet excellent in workability, characterized by containing, in weight %, 0.010% or less of C, 0.1 to 1.5% of Mn, 0.1 to 4% of Si, 0.1 to 4% of Al, wherein the latter three elements satisfy the formula Si+Mn+Al≦5.0%, 0.0005 to 0.0200% of Mg, and the remainder consisting of Fe and unavoidable impurities, (2) a low iron loss non-oriented electrical steel sheet excellent in workability, containing, in weight %, 0.010% or less of C, 0.1 to 1.5% of Mn, 0.1 to 4% of Si, 0.1 to 4% of Al, wherein the latter three elements satisfy the formula Si+Mn+Al≦5.0%, 0.0005% or more of Mg, 0.0005% or more of Ca, wherein the total amount of Mg and Ca is 0.0200% or less, and the remainder consisting of Fe and unavoidable impurities, (3) a low iron loss non-oriented electrical steel sheet excellent in workability, containing, in weight %, 0.010% or less of C, 0.1 to 1.5% of Mn, 0.1 to 4% of Si, 0.1 to 4% of Al, wherein the latter three elements satisfy the formula Si+Mn+Al≦5.0%, 0.0005% or more of Mg, 0.0005% or more of REM, wherein the total amount of Mg and REM is 0.0200% or less, and the remainder consisting of Fe and unavoidable impurities, (4) a low iron loss non-oriented electrical steel sheet excellent in workability, containing, in weight %, 0.010% or less of C, 0.1 to 1.5% of Mn, 0.1 to 4% of Si, 0.1 to 4% of Al, wherein the latter three elements satisfy the formula Si+Mn+Al≦5.0%, 0.0005% or more of Mg, 0.0005% or more of Ca and 0.0005% or more of REM, wherein the total amount of Mg, Ca and REM is 0.0200% or less, and the remainder consisting of Fe and unavoidable impurities, (5) a low iron loss non-oriented electrical steel sheet excellent in workability according to item (1) or (2), characterized by the amount of S contained in said steel sheet not exceeding 0.010% in weight %, (6) a method for producing a low iron loss non-oriented electrical steel sheet excellent in workability, characterized by deoxidizing molten steel with Al and then adding Mg source therein when refining the steel containing, in weight %, 0.010% or less of C, 0.1 to 1.5% of Mn, 0.1 to 4% of Si, 0.1 to 4% of Al, 0.0005 to 0.0200% of Mg, and the remainder consisting of Fe and unavoidable impurities, (7) a method for producing a low iron loss non-oriented electrical steel sheet excellent in workability, characterized by adding at least one or more of Mg source, Ca source and REM source in molten steel after deoxidizing the molten steel with Al when refining the steel containing, in weight %, 0.010% or less of C, 0.1 to 1.5% of Mn, 0.1 to 4% of Si, 0.1 to 4% of Al, 0.0005% or more of Mg, 0.0005% or more of Ca, 0.0005% or more REM, wherein the total amount of Mg, Ca and REM is 0.0200% or less, and the remainder consisting of Fe and unavoidable impurities, (8) a method for producing a low iron loss non-oriented electrical steel sheet excellent in workability according to item (6) or (7), characterized by reheating a slab containing said component, hot-rolling the slab, pickling the hot-rolled sheet after hot rolling or after hot rolling and then annealing, producing the steel sheet with a product thickness by single cold-rolling or two or more cold-rolling while rendering intermediate annealing in between, and then finish-annealing the steel sheet at a temperature of 700 to 1,100° C. in a continuous annealing line, (9) a method for producing a low iron loss non-oriented electrical steel sheet excellent in workability according to any one of items (6) to (8), characterized by the amount of S contained in said steel sheet not exceeding 0.010% by weight.

DESCRIPTION OF THE PREFERRED EMBODIMENT

The present invention will be explained in detail hereunder.

The present inventors have selected elements to be added to a steel sheet considering the following points as a guideline to produce a material with excellent grain growth property. That is, the present inventors, so as not to precipitate fine MnS, have selected elements (1) whose S compounds commence to precipitate at a temperature higher than the temperature at which MnS commences to precipitate and (2) whose S compounds or oxides can act as the precipitation nuclei of MnS even though MnS precipitates.

As a candidate of (1), the present invention has selected Mg in contrast to Ce employed in Japanese Unexamined Patent Publication No. S51-62115 and Ca employed in Japanese Unexamined Patent Publication No. S59-74213. Though the data on the precipitation of MgS are not well known, it is estimated that MgS commences precipitation at a temperature higher than the temperature at which MnS commences to precipitate since MgS is stabler than MnS from the viewpoint of free energy.

As candidates of (2), in addition to aforementioned elements, elements contained in a non-oriented electrical steel sheet were evaluated by the lattice distortion δ of MnS with their S compounds and oxides. The lattice distortion δ is defined in the following formula:

$$\delta=|a-a_o|/a_o$$

wherein, $a_o$: lattice constant of MnS a: lattice constant of each S compound or oxide.

The results are shown in Table 1. Table 1 means that the smaller the lattice distortion δ with MnS, the better the coherence with MnS and the easier the formation of nuclei when MnS precipitates. In this case, it is understood that MgS is remarkably more effective than other chemical compounds as a function of the precipitation nuclei of MnS.

TABLE 1

Lattice distortion of each chemical compound with MnS

| Chemical compound | Lattice distortion δ with MnS (%) |
|---|---|
| MgS | 0.6 |
| $CeO_2$ | 2.2 |
| $Ce_2O_3$ | 3.8 |
| CaO | 8.5 |
| CaS | 9.0 |
| MnO | 15.7 |
| MgO | 19.8 |
| $TiO_2$ | 23.8 |
| $Al_2O_3$ | 27.0 |
| $SiO_2$ | 33.5 |

From the above evaluation, it has been clarified that it is effective to add Mg as an additive element for suppressing the fine precipitation of MnS which causes the worst adverse effect on crystal grain growth and to generate MgS in a steel sheet.

Next, the present inventors carried out the following experiments to confirm the effect of Mg which was judged to be effective as a result of aforementioned consideration. Molten material was produced by applying vacuum melting and adding 2.0% of Si, 0.4% of Al, 0.2% of Mn, 0.0015% of C and 0.0032% of S as additive elements to Fe in a laboratory. At that time, oxygen in the molten material was as sufficiently low as about 0.0003%. Then the molten material was divided and poured into four bulks. No additive was added to one of them and Ca compounds, Ce compounds and Mg compounds were added to the other three bulks.

The aforementioned steel ingots thus produced were subjected to hot rolling after reheating to a temperature of 1,100° C. and produced into hot-rolled sheets with a thickness of 2.3 mm. The hot-rolled sheets were annealed for 60 seconds at the temperatures of 950 and 1,100° C. and then reduced to the final thickness of 0.50 mm by cold-rolling. Further, the steel sheets were subjected to continuous annealing for 60 seconds at the temperature of 750° C., their average crystal grain diameters were measured by the segment method, then the steel sheets were subjected to box annealing for 120 minutes at the temperature of 750° C. assuming stress relief annealing after punching cores at users, and magnetism and average crystal grain diameters were measured.

Table 2 shows each additive and its addition amount, the crystal grain diameters after continuous annealing, and the measurement results of magnetism and the crystal grain diameters after box annealing. Here, magnetism is measured by the SST method and the values of core loss at W15/50 (iron loss at the maximum magnetic flux density of 1.5T and the frequency of 50 Hz) are expressed by the average of L and C directions.

From Table 2, it is understood that the samples of reference numbers 7 and 8 designating the cases that Mg is added have better crystal grain growth after box annealing than other samples. As a result, the values of iron loss at W15/50 after box annealing are not more than 2.8 W/kg and are very good.

TABLE 2

Relationship of each additive with magnetic property and crystal grain diameter

| Reference number | Additive | Annealing temperature of hot-rolled sheet (° C.) | Grain diameter before box annealing (μm) | Grain diameter after box annealing (μm) | Iron loss W15/50 (W/kg) | Note |
|---|---|---|---|---|---|---|
| 1 | None | 950 | 25 | 65 | 2.92 | Comparative example |
| 2 | | 1100 | 20 | 44 | 3.23 | Comparative example |
| 3 | Ca 32 ppm | 950 | 30 | 91 | 2.81 | Comparative example |
| 4 | | 1100 | 25 | 76 | 2.86 | Comparative example |
| 5 | Ce 40 ppm | 950 | 30 | 82 | 2.84 | Comparative example |
| 6 | | 1100 | 25 | 67 | 2.90 | Comparative example |
| 7 | Mg 19 ppm | 950 | 30 | 105 | 2.73 | Inventive example |
| 8 | | 1100 | 25 | 105 | 2.73 | Inventive example |

As mentioned above, the present inventors have newly found a method to form MgS as a means to improve crystal grain growth property of a non-oriented electrical steel sheet and have completed the present invention.

The present inventors have selected elements to be added to a steel sheet considering the following cases as a guideline to produce a material with excellent grain growth property. They are (1) the case of reheating a slab or annealing a hot-rolled sheet at a high temperature and (2) the case of S being contained abundantly in steel.

(1) is the case of sufficiently growing crystal grains after the completion of hot rolling by reheating a slab at a high temperature as a substitute for annealing a hot-rolled sheet or the case of attempting to obtain a higher magnetic flux density by annealing a hot-rolled sheet at a high temperature. On the other hand, (2) assumes the case that the amount of S which is an unavoidable impurity increases in a practical steelmaking process.

Case (2) can be dealt with, as mentioned above, by securing the function of MgS, which has very good lattice coherence with MnS, as the precipitation nuclei of MnS. However, the thermal stability of MgS is questionable when a slab reheating temperature or a hot-rolled sheet annealing temperature is very high. Therefore, the present inventors have devised to combine the formation of CaS and/or sulfides of REM, which is very stable even at a high temperature and is apt to become coarse precipitates, to cope with case (1).

Firstly, the following experiments were carried out on the case (1) of annealing hot-rolled sheets at a high temperature. Molten material was produced by applying vacuum melting and adding 1.7% of Si, 0.4% of Al, 0.2% of Mn, 0.0015% of C and 0.0024% of S as additive elements to Fe at a laboratory. At that time, oxygen in the molten material was as sufficiently low as about 0.0003%. Then the molten material was divided and poured into five bulks. No additive was added to one of them, and Mg alloys or Mg alloys plus Ca alloys were added to the other four bulks.

Aforementioned steel ingots thus produced were subjected to hot rolling after reheating to the temperature of 1,100° C. and produced into hot-rolled sheets in the thickness of 2.3 mm. The hot-rolled sheets were annealed for 60 seconds at the temperatures of 950 and 1,150° C. and then reduced to the final thickness of 0.50 mm by cold-rolling. Further, the steel sheets were subjected to continuous annealing for 30 seconds at the temperature of 800° C., and then the steel sheets were subjected to box annealing for 2 hours at a temperature of 750° C. assuming stress relief annealing after punching cores at users, and magnetism was measured.

Table 3 shows the addition amount of each additive and the measurement results of magnetism. Here, magnetism is measured by the SST method and the values of iron loss at W15/50 (iron loss at the maximum magnetic flux density of 1.5T and the frequency of 50 Hz) are expressed by the average of L and C directions.

TABLE 3

Relationship between the addition amount of each additive and magnetic property

| Sample reference number | Mg amount (ppm) | Ca amount (ppm) | Annealing temperature of hot-rolled sheet (° C.) | Magnetic flux density B50 (T) | Iron loss W15/50 (W/kg) | Note |
|---|---|---|---|---|---|---|
| 1 | None | None | 950 | 1.695 | 3.03 | Comparative |
| 2 | | | 1150 | 1.709 | 3.65 | example |
| 3 | 12 | None | 950 | 1.700 | 2.85 | Comparative |
| 4 | | | 1150 | 1.713 | 2.90 | example |
| 5 | 12 | 6 | 950 | 1.701 | 2.77 | Invention |
| 6 | | | 1150 | 1.715 | 2.84 | example |
| 7 | 12 | 14 | 950 | 1.702 | 2.75 | Invention |

TABLE 3-continued

Relationship between the addition amount of each additive and magnetic property

| Sample reference number | Mg amount (ppm) | Ca amount (ppm) | Annealing temperature of hot-rolled sheet (° C.) | Magnetic flux density B50 (T) | Iron loss W15/50 (W/kg) | Note |
|---|---|---|---|---|---|---|
| 8 | | | 1150 | 1.717 | 2.79 | example |
| 9 | 12 | 26 | 950 | 1.702 | 2.75 | Invention |
| 10 | | | 1150 | 1.717 | 2.78 | example |

According to Table 3, in the cases that the annealing temperature of hot-rolled sheets is as low as 950° C., the values of core loss are not more than 3.0 W/kg and are good due to the Mg addition in the amount of 12 ppm as shown in Samples 3, 5, 7 and 9. The reason is thought to be that S becomes MgS which is a thermally stable chemical compound and MgS precipitates more coarsely than MnS which is inferior in thermal stability.

In the cases that the annealing temperature of hot-rolled sheets is as high as 1,150° C., the iron loss is inferior to that of the samples processed at the temperature of 950° C. The reason is that MnS dissolves again at 1,150° C., precipitates finely at the succeeding continuous annealing, and prevents the crystal grain growth at stress relief annealing. In Sample 4 wherein only 12 ppm of Mg is added, its effect is small though it is better than Sample 2 wherein Mg is not added. This shows the possibility that MgS dissolves to some extent at 1,150° C. and, as a result, fine MnS is formed in continuous annealing.

On the other hand, in Samples 6, 8 and 10 wherein Ca is further added in addition to the Mg addition of 12 ppm, the values of core loss are not more than 3.0 W/kg and are good even though the annealing temperature of hot-rolled sheets is 1,150° C. The reason is estimated that, as expected in the beginning, very stable CaS is formed even at a high temperature of 1,150° C. Therefore, in case (1) of reheating a slab or annealing a hot-rolled sheet at a high temperature, mere Mg addition is insufficient and Ca addition is needed.

Secondly, the following experiments were carried out on case (2) of containing S abundantly in steel. Molten material was produced by applying vacuum melting, adding 2.1% of Si, 0.3% of Al, 0.2% of Mn and 0.0012% of C and varying S amount in two levels (28 and 47 ppm) as additive elements to Fe at a laboratory. At that time, oxygen in the molten material was as sufficiently low as about 0.0003%. Then the molten material was divided and poured into five bulks. No additive was added to one of them and Ca alloys or Ca alloys plus Mg alloys were added to the other four bulks.

Aforementioned steel ingots thus produced were subjected to hot rolling after reheating to the temperature of 1,100° C. and produced into hot-rolled sheets in the thickness of 2.3 mm. The hot-rolled sheets were annealed at the temperatures of 1,000° C. and then reduced to the final thickness of 0.50 mm by cold-rolling. Further, the steel sheets were subjected to continuous annealing for 30 seconds at the temperature of 800° C., and then the steel sheets were subjected to box annealing for 2 hours at the temperature of 750° C. assuming stress relief annealing after punching cores, by users, and magnetism was measured.

Table 4 shows the addition amount of each additive and the measurement results of magnetism. Here, magnetism is measured by the SST method and the values of iron loss at W15/50 (iron loss at the maximum magnetic flux density of 1.5T and the frequency of 50 Hz) are expressed by the average of L and C directions. According to Table 4, in the cases that S amount is as low as 28 ppm, the values of iron loss are not more than 3.0 W/kg and are good due to the Ca addition in the amount of 20 ppm as shown in Samples 3, 5, 7 and 9. The reason is thought to be that S becomes CaS which is a thermally stable chemical compound and CaS precipitates more coarsely than MnS which is inferior in thermal stability.

In the cases that S amount is as abundant as 47 ppm, the iron loss is inferior to that in the cases that S amount is as low as 28 ppm. The reason is that the amount of MnS which adversely affects crystal grain growth increases and that prevents the crystal grain growth at stress relief annealing. In Sample 4 wherein only 20 ppm of Ca is added, its effect is small though it is better than Sample 2 wherein Ca is not added. It is thought that this is because not only CaS exists but also the existence of MnS becomes inevitable when S amount is abundant.

On the other hand, in Samples 6, 8 and 10 wherein Mg is further added in addition to the Ca addition of 20 ppm, the values of iron loss are not more than 3.0 W/kg and are good even when S amount is as abundant as 47 ppm. The reason is thought to be that, as expected in the beginning, MgS functions sufficiently as precipitation nuclei of MnS by forming a small amount of MgS having good lattice coherence with MnS even though S cannot be fixed as coarse precipitates of CaS. Therefore, in case (2) of containing S amount abundantly, mere Ca addition is insufficient and Mg addition is needed.

TABLE 4

Relationship between the addition amount of each additive and magnetic property

| Sample reference number | Ca amount (ppm) | Mg amount (ppm) | S amount (ppm) | Magnetic flux density B50 (T) | Iron loss W15/50 (W/kg) | Note |
|---|---|---|---|---|---|---|
| 1 | None | None | 28 | 1.701 | 3.01 | Comparative |
| 2 | | | 47 | 1.693 | 3.22 | example |
| 3 | 21 | None | 28 | 1.710 | 2.92 | Comparative |
| 4 | | | 47 | 1.703 | 3.03 | example |
| 5 | 21 | 5 | 28 | 1.712 | 2.79 | Invention |
| 6 | | | 47 | 1.708 | 2.87 | example |
| 7 | 21 | 16 | 28 | 1.713 | 2.78 | Invention |
| 8 | | | 47 | 1.710 | 2.84 | example |
| 9 | 21 | 26 | 28 | 1.713 | 2.78 | Invention |
| 10 | | | 47 | 1.711 | 2.83 | example |

Based on the above results, the present inventors have newly found out a method to add Mg and Ca in combination as a means to improve the crystal grain growth property of a non-oriented electrical steel sheet assuming the cases of (1) reheating a slab or annealing a hot-rolled sheet at a high temperature and (2) containing S abundantly in steel, and have completed the present invention.

Furthermore, the present inventors have newly found out methods to and Mg and REM, or to add combinations of Mg, Ca and REM as a means to improve the crystal grain growth property of a non-oriented electrical steel sheet, as shown in Example 6 or 7, and have complete the present invention.

Next, the reasons for limiting numerical values of conditions in the present invention will be explained hereunder.

The reason of setting the upper limit of C at 0.010% is because the value of iron loss deteriorates due to the existence of carbides if they exceed 0.010%.

The reasons of setting the lower limit of Mn at 0.1% and the upper limit thereof at 1.5% are because, if Mn is less than 0.1%, MnS precipitates finely and adversely affects the grain growth property greatly and, if Mn exceeds 1.5%, Mn in solid solution deteriorates the grain growth property. Further, the more desirable range of Mn is $0.2 \leqq Mn \leqq 1.0\%$.

The ranges of Si and Al are set at 0.1 to 4% for Si and 0.1 to 4% for Al, respectively. The reasons are because, in a range where Si and Al amounts are too small, the value of iron loss at W15/50 is inferior since specific resistance is small and, when Si and Al amounts are too much, the grain growth property deteriorates. Therefore, above-mentioned ranges are determined. Further, the total amount of Si, Al and Mn is set at not more than 5.0%. This is because the grain growth property deteriorates when the total amount exceeds 5.0%. Further, the more desirable ranges are $0.5 \leqq Si \leqq 2.5\%$, $0.2 \leqq Al \leqq 2.5\%$ and $1.5 \leqq Si+Mn+Al \leqq 3.5\%$.

The range of Mg addition amount is set at 0.0005 to 0.0200%. This is because, as shown in Example 1, when Mg is less than 0.0005%, too little MgS is formed and it has no effect on the improvement of grain growth property, and Mg amount exceeding 0.0200% is in the range of saturating the effect of Mg addition resulting in only alloy cost increase and that is not very desirable. In the Mg amount range, the desirable range is 0.0010 to 0.0100%, and more specifically it is further desirable that the Mg amount is controlled to 0.0015 to 0.0050%.

Furthermore, when Mg and Ca are added in combination, the amounts of Mg and Ca are set at 0.0005% or more, respectively. This is because the effect of the improvement of crystal grain growth property is demonstrated by the addition of 5 ppm or more as shown in Tables 3 and 4. Further, the total amount of Mg and Ca is set at 0.0200% or less. This is because the effect is saturated if they are added above necessity resulting only in alloy cost increase and that is not very desirable. As for the amount of Mg and Ca, the desirable range is 0.0010 to 0.0100%, and more specifically it is further desirable that the amount is controlled to 0.0015 to 0.0050%.

When Mg and REM are added in combination, the amounts of Mg and REM are set at 0.0005% or more, respectively. This is because the effect of the improvement of crystal grain growth property is demonstrated by the addition of 5 ppm or more as shown in Table 10. Further, the total amount of Mg and REM is set at 0.0200% or less. This is because the effect is saturated if they are added above necessity resulting only in alloy cost increase and that is not very desirable. In the amount of Mg and REM, the desirable range is 0.0010% to 0.0100%, and more specifically it is further desirable that the amount is controlled to 0.0015 to 0.0050%.

Furthermore, when Mg, Ca and REM are added in combination, each amount is set at 0.0005% or more. This is because the effect of the improvement of crystal grain growth property is demonstrated by the addition of 5 ppm or more as shown in Table 11. Further, the total amount of Mg, Ca and REM is set at 0.0200% or less. This is because the effect is saturated if they are added above necessity resulting only in alloy cost increase and that is not very desirable. As for the total amount of Mg, Ca and REM, the desirable range is 0.0015 to 0.0100%, and more specifically it is further desirable that the total amount is controlled to 0.0015 to 0.0050%.

The upper limit of S amount existing in steel is set at 0.010%. This is because, as shown in Examples 2 and 5, when S amount exceeds 0.010%, fine MnS is formed very abundantly and therefore the crystal grain growth property cannot be improved any more even though Ca or Mg is added. In the S amount range of 0.010% or less, the desirable range is 0.005% or less, and more specifically it is further desirable that the S amount is controlled to 0.003% or less from the viewpoint of the magnetic property.

Next, operation conditions at each process will be explained hereunder.

In the steel comprising the aforementioned component, the component is adjusted at refining in steelmaking process. Though Mg, Ca and REM are added at that time, at least one of them must be added after deoxidizing molten steel with Al. The reason is that when the deoxidization is insufficient, MgS, CaS or sulfides of REM are not formed but MgO, CaO or oxides of REM are formed even if Mg or Ca or REM is added and thus the effect of improving crystal grain growth property disappears. Here, a method such as preliminarily deoxidizing molten steel with Si may jointly be adopted prior to Al deoxidation.

Types of Mg and Ca sources are not particularly specified, but alloys composed of Fe—Mg—X and Fe—Ca—X (X is the third element) respectively and the like are desirable from the viewpoint of handling ease, etc. As for REM sources, REM alloys are desirable also form the view point of handling ease, etc.

Meanwhile, an Mg added non-oriented electrical steel sheet is disclosed in Japanese Unexamined Patent Publication No. H10-212555 and the gist is to form MgO positively, to increase MgO ratio in the composition of oxidic inclusions and to decrease the ratio of MnO which adversely affects magnetic property. However, since the amount of soluble Al added is as low as 0.0001 to 0.002%, the deoxidation is insufficient compared with the present invention and thus MgS is hardly formed. On the other hand, the novel knowledge by the present inventors is based on adding Mg after rendering sufficient dexidation by adding 0.1% or more of Al for forming MgS without forming MgO. In the above sense, the present invention is an invention based on the concept totally different from the technology disclosed in Japanese Unexamined Patent Publication No. H10-212555.

In the processes succeeding the steelmaking process, a slab is hot-rolled after reheated, and the hot-rolled sheet is pickled after being hot-rolled or after being hot-rolled and then is annealed and is reduced in a product thickness by single cold-rolling or two or more cold-rollings while rendering intermediate annealing in between. Here, the final cold reduction ratio is not particularly specified but it is desirable that it is set in the range of 70 to 90% from the viewpoint of magnetic property.

The upper limit and lower limit of finish annealing temperature are set at 700° C. and 1,100° C., respectively. The reasons are that with a temperature being less than 700° C., recrystallization becomes insufficient making grain growth difficult in succeeding box annealing at users, and with a temperature exceeding 1,100° C., a crystal grain diameter is too big resulting in the deterioration of both workability such as the punching of motor cores, etc. and iron loss property. In above range, a much better range of annealing temperature is 700 to 1,050° C. The annealing time is not particularly specified but it is desirable that the range is 10 to 120 seconds from the viewpoints of the promotion of recrystallization and the productivity.

EXAMPLE 1

Molten material having the component of 1.0% of Si, 0.9% of Al, 0.3% of Mn, 0.0015% of C and 0.0038% of S was subjected to vacuum melting at a laboratory. Further, Mg alloy was added when the molten material was divided and poured and finally steel ingots containing 4 to 210 ppm of Mg were produced. After reheating the steel ingots, hot-rolled sheets with the thickness of 2.3 mm were produced, annealed for 80 seconds at 1,080° C. and pickled. Then the hot-rolled sheets were reduced to the thickness of 0.50 mm by cold-rolling and then subjected to finish annealing for 40 seconds at 750° C. Further, samples were cut out for SST measurement and subjected to box annealing for 2 hours at 750° C. assuming stress relief annealing at users.

The results of measuring crystal grain diameters before and after box annealing and magnetism after box annealing are shown in Table 5. Samples 2 to 9 with the Mg addition amounts of 5 ppm or more have large grain diameters after box annealing and the values of iron loss at W15/50 are 2.8 W/kg or less and are good. Among these samples, Sample 9 with the addition amount of over 200 ppm is excluded from the present invention since the effect of Mg addition is saturated and therefore the addition merely increases alloy cost. Among these samples, those demonstrating sufficient effects corresponding to Mg addition amounts are Samples 3 to 7 with the Mg amounts of 0.0010 to 0.0100%.

TABLE 5

Relationship of Mg addition amount with magnetic property and crystal grain diameter

| Reference number | Mg amount (ppm) | Grain diameter before box annealing (μm) | Grain diameter after box annealing (μm) | Iron loss W15/50 (W/kg) | Note |
|---|---|---|---|---|---|
| 1 | 4 | 20 | 66 | 2.90 | Comparative example |
| 2 | 8 | 25 | 95 | 2.78 | Invention example |
| 3 | 14 | 25 | 100 | 2.76 | Invention example |
| 4 | 29 | 25 | 105 | 2.74 | Invention example |
| 5 | 55 | 25 | 110 | 2.72 | Invention example |
| 6 | 76 | 25 | 115 | 2.70 | Invention example |
| 7 | 96 | 25 | 117 | 2.69 | Invention example |
| 8 | 155 | 25 | 120 | 2.68 | Invention example |
| 9 | 210 | 25 | 120 | 2.68 | Comparative example |

EXAMPLE 2

Molten material containing 2.0% of Si, 0.6% of Al, 0.2% of Mn, 0.0011% of C, 0.0020% of Mg and S amount variously changed was subjected to vacuum melting in a laboratory. Hot-rolled sheets with the thickness of 2.2 mm were produced from the material, annealed for 50 seconds at 1,080° C. and pickled. Then the hot-rolled sheets were reduced to the thickness of 0.50 mm by cold-rolling and then subjected to finish annealing for 40 seconds at 750° C. Further, samples were cut out for SST measurement and subjected to box annealing for 2 hours at 750° C. assuming stress relief annealing at users.

The results of measuring crystal grain diameters before and after box annealing and magnetism after box annealing are shown in Table 6. Samples 1 to 5 with the S addition amounts of 100 ppm or less have large grain diameters after box annealing and their values of iron loss at W15/50 are 2.8 W/kg or less and are good. The better range of S addition amount is 0.005% or less as represented by Samples 1 to 3, and more specifically Samples 1 and 2 with the amounts of 0.003% or less are much better.

TABLE 6

Relationship of S addition amount with magnetic property and crystal grain diameter

| Reference number | S amount (ppm) | Grain diameter before box annealing (μm) | Grain diameter after box annealing (μm) | Iron loss W15/50 (W/kg) | Note |
|---|---|---|---|---|---|
| 1 | 19 | 25 | 114 | 2.65 | Invention example |
| 2 | 26 | 20 | 110 | 2.67 | Invention example |
| 3 | 45 | 20 | 103 | 2.69 | Invention example |
| 4 | 56 | 20 | 88 | 2.77 | Invention example |
| 5 | 89 | 15 | 81 | 2.79 | Invention example |
| 6 | 105 | 15 | 55 | 3.01 | Comparative example |

EXAMPLE 3

Vacuum melting was carried out and steel ingots having the component of 2.0% of Si, 0.4% of Al, 0.5% of Mn, 0.0012% of C, 0.0031% of S and 0.0021% of Mg were produced in a laboratory. Hot-rolled sheets with the thickness of 2.2 mm were produced by reheating and hot-rolling the material, annealed for 60 seconds at 1,080° C. and pickled. Then the hot-rolled sheets were reduced to the thickness of 0.50 mm by cold-rolling and then subjected to finish annealing for 40 seconds at various temperatures. Further, samples were cut out for SST measurement and subjected to box annealing for 2 hours at 750° C. assuming stress relief annealing by users.

The results of measuring crystal grain diameters before and after box annealing and magnetism after box annealing are shown in Table 7. In Samples 2 to 8 having the finish annealing temperatures of 700 to 1,100° C., the values of iron loss at W15/50 are 2.8 W/kg or less and are good. In case of Sample 1, recrystallization is insufficient and grain diameters cannot be measured since the finish annealing temperature is too low, and moreover the grain diameters after box annealing are small since the sample passes through the processes of recrystallization and grain growth at the succeeding box annealing. In case of Sample 9, the magnetic property deteriorates since the crystal grain diameters after finish annealing are so excessively large as to deviate from the grain diameters most suitable for a good iron loss property. The better range of finish annealing temperature is 700 to 1,050° C. as represented by Samples 2 to 7.

TABLE 7

Relationship of finish annealing temperature with magnetic property and crystal grain diameter

| Reference number | Finish annealing temperature (° C.) | Grain diameter before box annealing (μm) | Grain diameter after box annealing (μm) | Iron loss W15/50 (W/kg) | Note |
|---|---|---|---|---|---|
| 1 | 650 | Unmeasurable | 71 | 2.81 | Comparative example |
| 2 | 700 | 20 | 103 | 2.76 | Invention example |
| 3 | 750 | 25 | 104 | 2.75 | Invention example |
| 4 | 800 | 36 | 106 | 2.75 | Invention example |

TABLE 7-continued

Relationship of finish annealing temperature with magnetic property and crystal grain diameter

| Reference number | Finish annealing temperature (° C.) | Grain diameter before box annealing (μm) | Grain diameter after box annealing (μm) | Iron loss W15/50 (W/kg) | Note |
|---|---|---|---|---|---|
| 5 | 900 | 51 | 108 | 2.74 | Invention example |
| 6 | 1000 | 102 | 110 | 2.73 | Invention example |
| 7 | 1050 | 140 | 140 | 2.71 | Invention example |
| 8 | 1100 | 179 | 179 | 2.73 | Invention example |
| 9 | 1150 | 231 | 231 | 2.86 | Comparative example |

EXAMPLE 4

Molten material having the component of 1.1% of Si, 1.3% of Al, 0.3% of Mn, 0.0015% of C and 0.0039% of S was subjected to vacuum melting at a laboratory. Further, Mg and Ca alloys were added when the molten material was divided and poured into six bulks, and steel ingots were produced. After reheating the steel ingots to the temperature of 1,100° C., hot-rolled sheets with the thickness of 2.3 mm were produced, annealed for 60 seconds at the temperatures of 950 and 1,150° C. Then the hot-rolled sheets were pickled, reduced to the thickness of 0.50 mm by cold-rolling and then subjected to finish annealing for 40 seconds at 800° C. Further, samples were cut out for SST measurement and subjected to box annealing for 2 hours at 750° C. assuming stress relief annealing at users.

The results of measuring magnetism after box annealing are shown in Table 8. In Samples 5 to 12 wherein the total addition amounts of Mg and Ca are 10 ppm or more, the values of iron loss are 3.0 W/kg or less and are good. Among these samples, those demonstrating sufficient effect corresponding to the addition of Mg and Ca amounts are Samples 5 to 10 having the total amounts of Mg and Ca in the range of 0.0010 to 0.0050%. In case of Samples 11 and 12, the effect is saturated.

TABLE 8

Relationship between the addition amount of each additive and magnetic property

| Sample reference number | Mg amount (ppm) | Ca amount (ppm) | Mg + Ca (ppm) | Annealing temperature of hot-rolled sheet (° C.) | Magnetic flux density B50 (T) | Iron loss W15/50 (W/kg) | Note |
|---|---|---|---|---|---|---|---|
| 1 | None | None | 0 | 950 | 1.685 | 3.02 | Comparative |
| 2 | | | | 1150 | 1.700 | 3.59 | example |
| 3 | 3 | 3 | 6 | 950 | 1.685 | 3.01 | Comparative |
| 4 | | | | 1150 | 1.701 | 3.45 | example |
| 5 | 5 | 5 | 10 | 950 | 1.689 | 2.88 | Invention example |
| 6 | | | | 1150 | 1.702 | 2.98 | |
| 7 | 11 | 10 | 21 | 950 | 1.691 | 2.79 | Invention example |
| 8 | | | | 1150 | 1.703 | 2.81 | |
| 9 | 18 | 19 | 37 | 950 | 1.692 | 2.77 | Invention example |
| 10 | | | | 1150 | 1.704 | 2.79 | |
| 11 | 27 | 28 | 55 | 950 | 1.692 | 2.77 | Invention example |
| 12 | | | | 1150 | 1.704 | 2.79 | |

EXAMPLE 5

Molten material containing 2.0% of Si, 0.4% of Al, 0.2% of Mn, 0.0011% of C, 0.0015% of Mg, 0.0019% of Ca and S amount variously changed was subjected to vacuum melting at a laboratory. Hot-rolled sheets with the thickness of 2.2 mm were produced from the material, annealed for 50 seconds at 970° C. and pickled. Then the hot-rolled sheets were reduced to the thickness of 0.50 mm by cold-rolling and then subjected to finish annealing for 40 seconds at 790° C. Further, samples were cut out for SST measurement and subjected to box annealing for 2 hours at 750° C. assuming stress relief annealing at users.

The results of measuring crystal grain diameters before and after box annealing and magnetism after box annealing are shown in Table 9. In Samples 1 to 5 having S addition amounts of 100 ppm or less, the values of iron loss are 3.0 W/kg or less and are good. The better range of S addition amount is 0.005% or less as represented by Samples 1 to 3.

TABLE 9

Relationship between the addition amount of each additive and magnetic property

| Sample reference number | Mg amount (ppm) | Ca amount (ppm) | S amount (ppm) | Magnetic flux density B50 (T) | Iron loss W15/50 (W/kg) | Note |
|---|---|---|---|---|---|---|
| 1 | 15 | 19 | 21 | 1.713 | 2.74 | Invention example |
| 2 | | | 34 | 1.710 | 2.77 | Invention example |
| 3 | | | 48 | 1.708 | 2.79 | Invention example |
| 4 | | | 74 | 1.706 | 2.86 | Invention example |
| 5 | | | 91 | 1.704 | 2.96 | Invention example |

TABLE 9-continued

Relationship between the addition amount of each additive and magnetic property

| Sample reference number | Mg amount (ppm) | Ca amount (ppm) | S amount (ppm) | Magnetic flux density B50 (T) | Iron loss W15/50 (W/kg) | Note |
|---|---|---|---|---|---|---|
| 6 | | | 106 | 1.698 | 3.11 | Comparative example |

EXAMPLE 6

Molten material having the component of 1.2% of Si, 1.2% of Al, 0.3% of Mn, 0.0018% of C and 0.0032% of S was subjected to vacuum melting at a laboratory. Further, Mg and REM alloys were added when the molten material was divided and poured into six bulks, and steel ingots were produced. After reheating the steel in ingots to the temperature of 1,100° C., hot-rolled sheets with the thickness of 2.3 mm were produced, annealed for 60 seconds at the temperatures of 950 and 1,150° C. Then the hot-rolled sheets were pickled, reduced to the thickness of 0.50 mm by cold-rolling and then subjected to finish annealing for 30 seconds at 820° C. Further, samples were cut out for SST measurement and subjected to box annealing for 2 hours at 750° C. assuming stress relief annealing at users.

The results of measuring magnetism after box annealing are shown in Table 10. In Samples 5 to 12 wherein the total addition amounts of Mg and REM are 10 ppm or more, the values of iron loss are 3.0 W/kg or less and are good. Among these samples, those demonstrating sufficient effect corresponding to the addition of Mg and REM amounts are Sample 5 to 10 having the total amounts in the range of 0.0010 to 0.0050%.

TABLE 10

Relationship between the addition of each additive and magnetic property

| Sample reference number | Mg amount (ppm) | REM amount (ppm) | Mg + REM (ppm) | Annealing temperature of hot-rolled sheet (° C.) | Magnetic flux density B50 (T) | Iron loss W15/50 (W/kg) | Note |
|---|---|---|---|---|---|---|---|
| 1 | None | None | 0 | 950 | 1.687 | 3.02 | Comparative |
| 2 | | | | 1150 | 1.698 | 3.60 | example |
| 3 | 3 | 5 | 8 | 950 | 1.687 | 3.01 | Comparative |
| 4 | | | | 1150 | 1.699 | 3.46 | example |
| 5 | 6 | 8 | 14 | 950 | 1.691 | 2.87 | Invention example |
| 6 | | | | 1150 | 1.700 | 2.99 | |
| 7 | 11 | 15 | 26 | 950 | 1.693 | 2.78 | Invention example |
| 8 | | | | 1150 | 1.701 | 2.82 | |
| 9 | 16 | 22 | 38 | 950 | 1.694 | 2.76 | Invention example |
| 10 | | | | 1150 | 1.702 | 2.79 | |
| 11 | 25 | 31 | 56 | 950 | 1.694 | 2.76 | Invention example |
| 12 | | | | 1150 | 1.702 | 2.79 | |

EXAMPLE 7

Molten material having the component of 1.0% of Si, 1.4% of Al, 0.3% of Mn, 0.0014% of C and 0.0034% of S was subjected to vacuum melting at a laboratory. Further, Mg, Ca and REM alloys were added when the molten material was divided and poured into six bulks, and steel ingots were produced. After reheating the steel in ingots to the temperature of 1,100° C., hot-rolled sheets with the thickness of 2.3 mm were produced, annealed for 60 seconds at the temperatures of 950 and 1,150° C. Then the hot-rolled sheets were pickled, reduced to the thickness of 0.50 mm by cold-rolling and then subjected to finish annealing for 45 seconds at 800° C. Further, samples were cut out for SST measurement and subjected to box annealing for 2 hours at 750° C. assuming stress relief annealing at users.

The results of measuring magnetism after box annealing are shown in Table 11. In Samples 5 to 12 wherein the total addition amounts of Mg, Ca and REM are 10 ppm or more, the values of iron loss are 3.0 W/kg or less and are good. Among these samples, those demonstrating sufficient effect corresponding to the addition of Mg, Ca and REM amounts are Sample 5 to 10 having the total amounts in the range of 0.0015 to 0.0050%.

TABLE 11

Relationship between the addition of each additive and magnetic property

| Sample reference number | Mg amount (ppm) | Ca amount (ppm) | REM amount (ppm) | Mg + Ca + REM (ppm) | Annealing temperature of hot-rolled sheet (° C.) | Magnetic flux density B50 (T) | Iron loss W15/50 (W/kg) | Note |
|---|---|---|---|---|---|---|---|---|
| 1 | None | None | None | 0 | 950 | 1.688 | 3.04 | Comparative |
| 2 | | | | | 1150 | 1.696 | 3.61 | example |
| 3 | 3 | 2 | 4 | 9 | 950 | 1.688 | 3.02 | Comparative |
| 4 | | | | | 1150 | 1.697 | 3.47 | example |
| 5 | 6 | 5 | 6 | 17 | 950 | 1.692 | 2.88 | Invention example |
| 6 | | | | | 1150 | 1.698 | 2.98 | |
| 7 | 10 | 9 | 12 | 31 | 950 | 1.694 | 2.79 | Invention example |
| 8 | | | | | 1150 | 1.699 | 2.81 | |
| 9 | 15 | 10 | 18 | 43 | 950 | 1.695 | 2.75 | Invention example |
| 10 | | | | | 1150 | 1.700 | 2.78 | |
| 11 | 20 | 15 | 22 | 57 | 950 | 1.695 | 2.75 | Invention example |
| 12 | | | | | 1150 | 1.700 | 2.78 | |

What is claimed is:

1. A low iron loss non-oriented electrical steel sheet excellent in workability, characterized by containing, in weight %, 0.010% or less of C, 0.1 to 1.5% of Mn, 0.1 to 4% of Si, 0.1 to 4% of Al, wherein the latter three elements satisfy the formula Si+Mn+Al≦5.0%, 0.0005 to 0.0200% of Mg, and the remainder consisting of Fe and unavoidable impurities.

2. A low iron loss non-oriented electrical steel sheet excellent in workability, characterized by containing, in weight %, 0.010% or less of C, 0.1 to 1.5% of Mn, 0.1 to 4% of Si, 0.1 to 4% of Al, wherein the latter three elements satisfy the formula Si+Mn+Al≦5.0%, 0.0005% or more of Mg, 0.0005% or more of Ca, wherein the total maximum amount of Mg and Ca is 0.0200%, and the remainder consisting of Fe and unavoidable impurities.

3. A low iron loss non-oriented electrical steel sheet excellent in workability, containing, in weight %, 0.010% or less of C, 0.1 to 1.5% of Mn, 0.1 to 4% of Si, 0.1 to 4% of Al, wherein the latter three elements satisfy the formula Si+Mn+Al≦5.0%, 0.0005% or more of Mg, 0.0005% or more of REM, wherein the total maximum amount of Mg and REM is 0.0200%, and the remainder consisting of Fe and unavoidable impurities.

4. A low iron loss non-oriented electrical steel sheet excellent in workability, containing, in weight %, 0.010% or less of C, 0.1 to 1.5% of Mn, 0.1 to 4% of Si, 0.1 to 4% of Al, wherein the latter three elements satisfy the formula Si+Mn+Al≦5.0%, 0.0005% or more of Mg, 0.0005% or more of Ca and 0.0005% or more of REM, wherein the total maximum amount of Mg, Ca and REM is 0.0200%, and the remainder consisting of Fe and unavoidable impurities.

5. A method for producing a low iron loss non-oriented electrical steel sheet excellent in workability, characterized by deoxidizing molten steel with Al and then adding Mg source therein when refining the steel containing, in weight %, 0.010% or less of C, 0.1 to 1.5% of Mn, 0.1 to 4% of Si, 0.1 to 4% of Al, 0.0005 to 0.0200% of Mg, and the remainder consisting of Fe and unavoidable impurities.

6. A low iron loss non-oriented electrical steel sheet excellent in workability according to claim 1, characterized by the amount of S contained in said steel sheet not exceeding 0.010% in weight %.

7. A low iron loss non-oriented electrical steel sheet excellent in workability according to claim 2, characterized by the amount of S contained in said steel sheet not exceeding 0.010% in weight %.

8. A method for producing a low iron loss non-oriented electrical steel sheet excellent in workability according to claim 5, characterized by reheating a slab containing said component, hot-rolling the slab, pickling the hot-rolled sheet after hot rolling or after hot rolling and then annealing, producing the steel sheet with a product thickness by single cold-rolling or two or more cold-rolling while rendering intermediate annealing in between, and then finish-annealing the steel sheet at a temperature of 700 to 1,100° C. in a continuous annealing line.

9. A method for producing a low iron loss non-oriented electrical steel sheet excellent in workability according to claim 5, characterized by the amount of S contained in said steel sheet not exceeding 0.010% in weight %.

10. A method for producing a low iron loss non-oriented electrical steel sheet excellent in workability according to claim 5, characterized by said deoxidizing the molten steel with Al and then further adding one or both of a Ca source and a REM source therein when refining the steel further, the resulting steel containing, in weight %, 0.0005% or more Ca and/or 0.0005% or more REM, wherein the total maximum amount of Mg, Ca and/or REM is 0.0200%, and the remainder consisting of Fe and unavoidable impurities.

11. A method for producing a low iron loss non-oriented electrical steel sheet excellent in workability according to claim 10, characterized by reheating a slab containing said component, hot-rolling the slab, pickling the hot-rolled sheet after hot rolling or after hot rolling and then annealing, producing the steel sheet with a product thickness by single cold-rolling or two or more cold-rolling while rendering intermediate annealing in between, and then finish-annealing the steel sheet at a temperature of 700 to 1,100° C. in a continuous annealing line.

12. A method for producing a low iron loss non-oriented electrical steel sheet excellent in workability according to claim 10, characterized by the amount of S contained in said steel sheet not exceeding 0.010% in weight %.

* * * * *